US006938702B2

(12) United States Patent
Saha et al.

(10) Patent No.: US 6,938,702 B2
(45) Date of Patent: Sep. 6, 2005

(54) METHOD AND EQUIPMENT FOR CONTROLLING OPERATION OF ROCK DRILLING APPARATUS

(75) Inventors: Heikki Saha, Tampere (FI); Markku Keskiniva, Tampere (FI); Antti Koskimäki, Tampere (FI); Esa Rantala, Kyrönlahti (FI); Tapani Pöysti, Tampere (FI); Vesa Peltonen, Tampere (FI); Jaakko Niemi, Tampere (FI); Timo Kemppainen, Tampere (FI); Vesa Uitto, Tampere (FI); Pauli Lemmetty, Tampere (FI)

(73) Assignee: Sandvik Inteleectual Property AB, Sandviken (SE)

( * ) Notice: Subject to any disclaimer, the term of this patent is extended or adjusted under 35 U.S.C. 154(b) by 0 days.

(21) Appl. No.: 10/497,860

(22) PCT Filed: Dec. 5, 2002

(86) PCT No.: PCT/FI02/00997

§ 371 (c)(1),
(2), (4) Date: Oct. 28, 2004

(87) PCT Pub. No.: WO03/050388

PCT Pub. Date: Jun. 19, 2003

(65) Prior Publication Data

US 2005/0056439 A1 Mar. 17, 2005

(30) Foreign Application Priority Data

Dec. 7, 2001 (FI) ..... 20012418

(51) Int. Cl.[7] ..... E21B 44/00

(52) U.S. Cl. ..... 173/1; 173/4; 173/11; 173/152

(58) Field of Search ..... 173/1, 2, 3, 4, 173/6, 11, 17, 19, 91, 152, 158; 175/25, 122, 296

(56) References Cited

U.S. PATENT DOCUMENTS

| | | | | |
|---|---|---|---|---|
| 3,561,542 A | * | 2/1971 | Hanson et al. | 173/1 |
| 3,666,025 A | | 5/1972 | Hanson et al. | |
| 3,669,197 A | | 6/1972 | Hanson et al. | |
| 3,670,826 A | | 6/1972 | Hanson et al. | |
| 3,979,944 A | * | 9/1976 | Salmi et al. | 173/8 |
| 4,246,973 A | * | 1/1981 | Mayer | 173/8 |
| 4,271,914 A | * | 6/1981 | Dressel | 173/158 |
| 4,275,793 A | * | 6/1981 | Schivley et al. | 173/9 |
| 4,356,871 A | * | 11/1982 | Fujikawa | 173/8 |
| 5,064,003 A | * | 11/1991 | Neroznikov et al. | 173/106 |
| 5,121,802 A | * | 6/1992 | Rajala et al. | 173/1 |
| 5,701,962 A | * | 12/1997 | Jantunen | 175/24 |
| 5,844,133 A | | 12/1998 | Goto et al. | |
| 6,112,832 A | | 9/2000 | Muuttonen et al. | |
| 6,209,661 B1 | | 4/2001 | Muona | |
| 6,491,114 B1 | * | 12/2002 | Webel | 173/206 |

FOREIGN PATENT DOCUMENTS

| | | |
|---|---|---|
| EP | 112810 | 7/1984 |
| FI | 105054 | 5/2000 |
| WO | WO0008303 | 2/2000 |
| WO | WO01 33043 | 5/2001 |

* cited by examiner

*Primary Examiner*—Scott A. Smith
(74) *Attorney, Agent, or Firm*—Ronald L. Grudziecki; Drinker, Biddle & Reath

(57) ABSTRACT

A method and an equipment for controlling the operation of a rock drilling apparatus, which rock drilling apparatus comprises a percussion device for producing impact energy to a tool of the rock drilling apparatus, a rotating device for rotating the tool in a drill hole, a feeding device for feeding the tool in the drill hole and a flushing device for supplying flushing agent through the tool and the bit for flushing loose drilling waste from the hole. The feed force and the percussion power are determined and the relation between the feed force and the percussion power is adjusted to a targeted operation area within an upper and a lower limit.

33 Claims, 11 Drawing Sheets

METHOD AND EQUIPMENT FOR CONTROLLING OPERATION OF ROCK DRILLING APPARATUS

The invention relates to a method for controlling the operation of a rock drilling apparatus, the rock drilling apparatus comprising a percussion device, a rotating device, a feeding device, a flushing device and a tool and a bit arranged in the tool, and in which rock drilling apparatus the percussion device is arranged to produce impact energy directed to the tool, the rotating device is arranged to rotate the tool in a drill hole, the feeding device is arranged to feed the tool in the drill hole and the flushing device is arranged to supply flushing agent through the tool and the bit for flushing the drilling waste from the hole.

The invention also relates to an equipment for controlling the operation of the rock drilling apparatus, the rock drilling apparatus comprising a percussion device, a rotating device, a feeding device, a flushing device and a tool and a bit arranged in the tool, and in which rock drilling apparatus the percussion device is arranged to produce impact energy directed to the tool, the rotating device is arranged to rotate the tool in a drill hole, the feeding device is arranged to feed the tool in the drill hole and the flushing device is arranged to supply flushing agent through the tool and the bit for flushing the drilling waste from the hole.

Rock drilling apparatuses and rock drill machines arranged therein are used for drilling and excavating rock in mines, quarries and land construction sites, for instance. When holes are drilled in a rock, the drilling conditions may vary in different ways. Layers in the rock mass may vary in hardness, and therefore characteristics affecting the drilling should be adjusted according to drilling resistance. In the drilling, there are simultaneously four different functions in use: rotating the drill in a hole to be drilled, breaking the rock by striking a drill shank with the percussion device as well as drill feed and flushing, by which drilling waste is removed from the drilled hole. When rock is broken by striking the drill shank with the percussion device, impact energy of the percussion device is transmitted by means of drill rods, which conventionally serve as extensions of the drill shank, to a drill bit which strikes on the rock making it break. Rock breakage is thus mainly caused by the effect of the impact and the purpose of the rotation is mainly to ensure that drill buttons of the drill bit, or other working parts, at the outer end of the drill rods always hit a new spot in the rock.

As the drilling conditions vary, the relations between the different drilling functions are crucial to a successful drilling result. Professional skills of the operator play thus a very important role in the successful drilling result, because in varying drilling conditions, in particular, it is extremely difficult to find the correct relations between the different drilling functions, especially, due to highly demanding operating conditions of the rock drilling apparatus, it is very difficult to arrange reliable automated systems, i.e. measuring and control systems, in the rock drilling apparatus and the drilling machine therein. Hence, because the successful drilling result relies to a great extent on the operator, long working experience is required of a good operator. On the other hand, as the operator moves from one device to another, it takes a new training period in the handling of the rock drilling apparatus to achieve a good drilling result.

It is an object of the present invention to provide a novel solution for controlling the operation of a rock drilling apparatus.

The method of the invention is characterized by determining feed force of a feeding device and percussion power of a percussion device and by controlling automatically the feed force of the feeding device and the percussion power of the percussion device on the basis of the feed force of the feeding device and the percussion power of the percussion device.

Further, the equipment of the invention is characterized by comprising means for determining feed force of a feeding device and percussion power of a percussion device and at least one control unit for adjusting the feed force of the feeding device and the percussion power of the percussion device automatically on the basis of the feed force of the feeding device and the percussion power of the percussion device.

The basic idea of the invention is that the operation of the rock drilling apparatus, which comprises a percussion device for producing impact energy to a tool of the rock drilling apparatus, a rotating device for rotating the tool in a drill hole, a feeding device for feeding the tool into the drill hole and a flushing device for supplying flushing agent through the tool and the bit for flushing detached drilling waste from the hole, is controlled by determining the feed force of the feeding device and the percussion power of the percussion device and by adjusting the feed force of the feeding device and the percussion power of the percussion device automatically on the basis of the feed force of the feeding device and the percussion power of the percussion device. One preferred embodiment of the invention comprises setting the highest and the lowest allowed feed forces of the feeding device and the percussion powers of the percussion device, setting the upper and the lower limits for the relation between the feed force of the feeding device and the percussion power of the percussion device, which upper and lower limits serve as limits for a targeted operating area of the mutual relation between the feed force of the feeding device and the percussion power of the percussion device, determining the relation between the feed force of the feeding device and the percussion power of the percussion device on the basis of the feed force of the feeding device and the percussion power of the percussion device and adjusting the feed force of the feeding device and the percussion power of the percussion device such that the relation between the feed force of the feeding device and the percussion power of the percussion device is within the targeted operating area limited by said upper and lower limits.

The invention has an advantage that the solution can be implemented in a simple manner, because the necessary sensor elements and other equipment can be implemented in a simple manner. Thanks to closed-loop control, i.e. controlling the drilling automatically on the basis of measurements, it is easy to use the rock drilling apparatus also in demanding drilling conditions and the operator can learn easily and quickly how to use different rock drilling apparatuses. By maintaining the drilling within the desired targeted operating area, instead of a given, desired value, it is possible to reduce considerably the vibration risk of the drilling control system associated with the drilling situation. The solution reduces readily and simply the stress, to which the drilling equipment is subjected, and prevents the equipment from getting damaged during the normal operation of the rock drill machine or due to the misuse of the rock drill machine.

In the following the invention will be described in greater detail in the attached drawings, wherein FIG. 1 is a schematic side view of a rock drilling apparatus, to which the solution of the invention is applied;

Figure 11A:
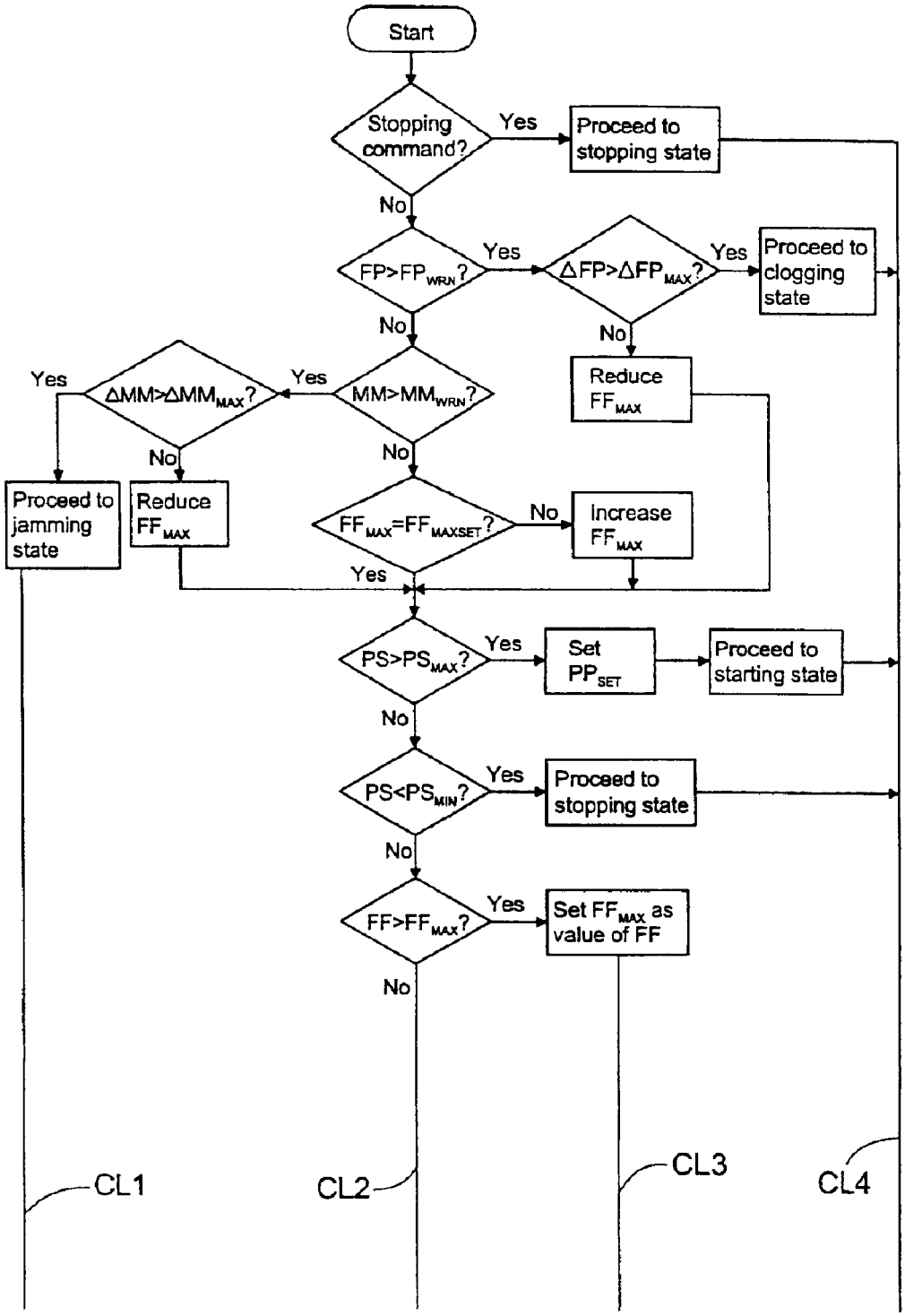
Figure 11B:
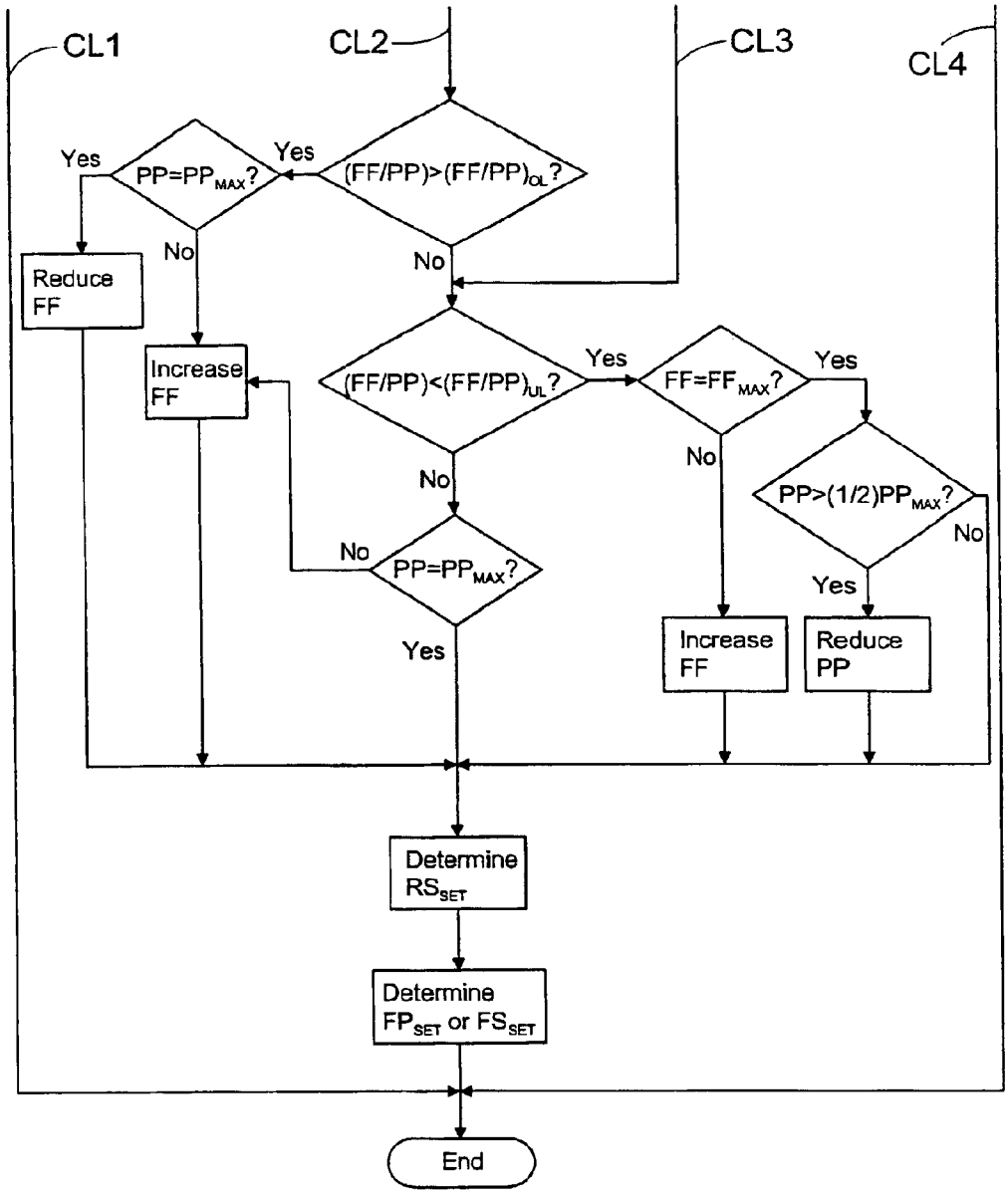
Figure 12:
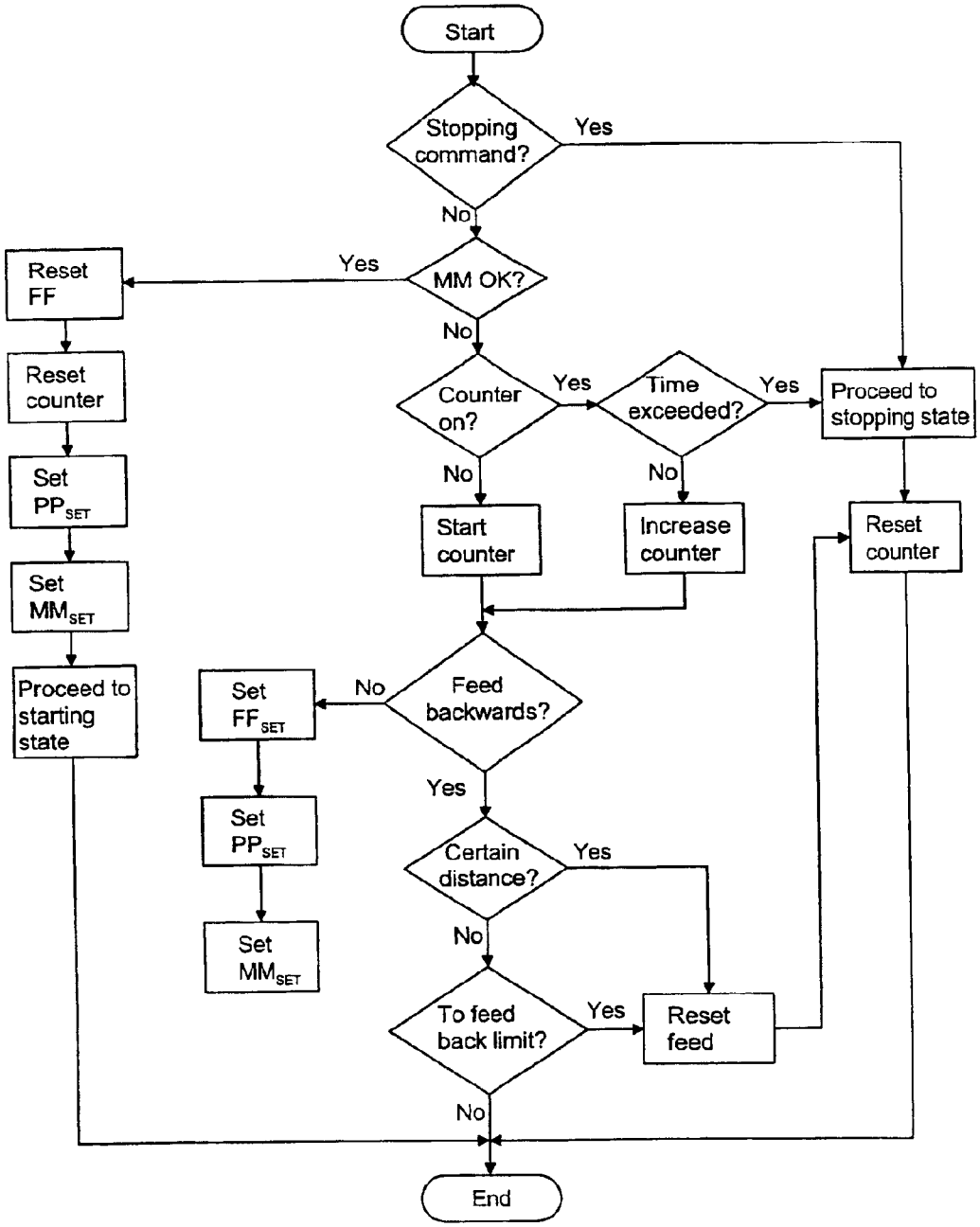
Figure 13:
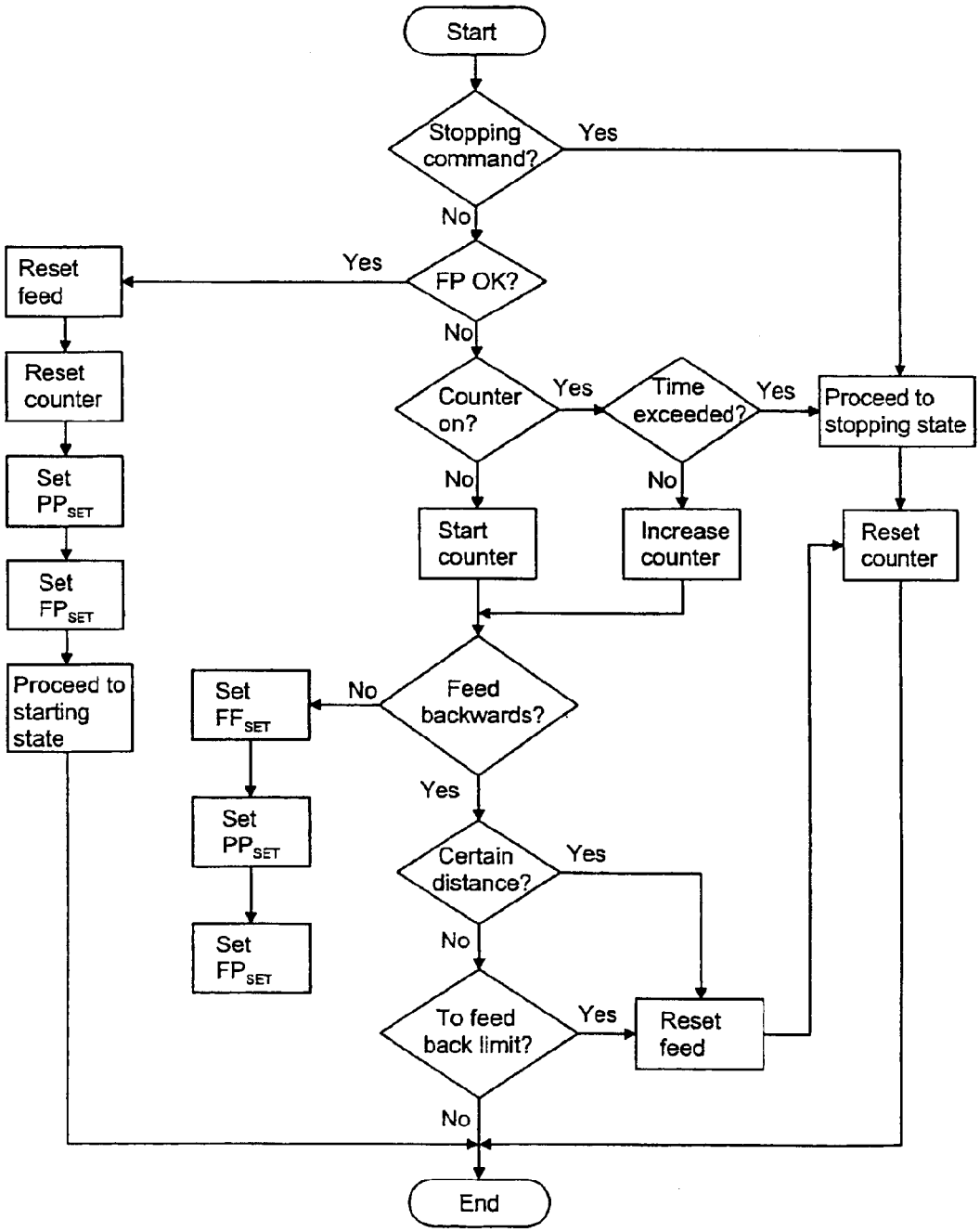

FIGS. 11*a* and 11*b* are block diagrams of the operating principle of a normal drilling state of the rock drilling apparatus;

FIG. 12 is a block diagram of the operating principle of a jamming state of the rock drilling apparatus, and FIG. 13 is a block diagram of the operating principle of a state of clogged flushing holes in the rock drilling apparatus.

Figure 1:
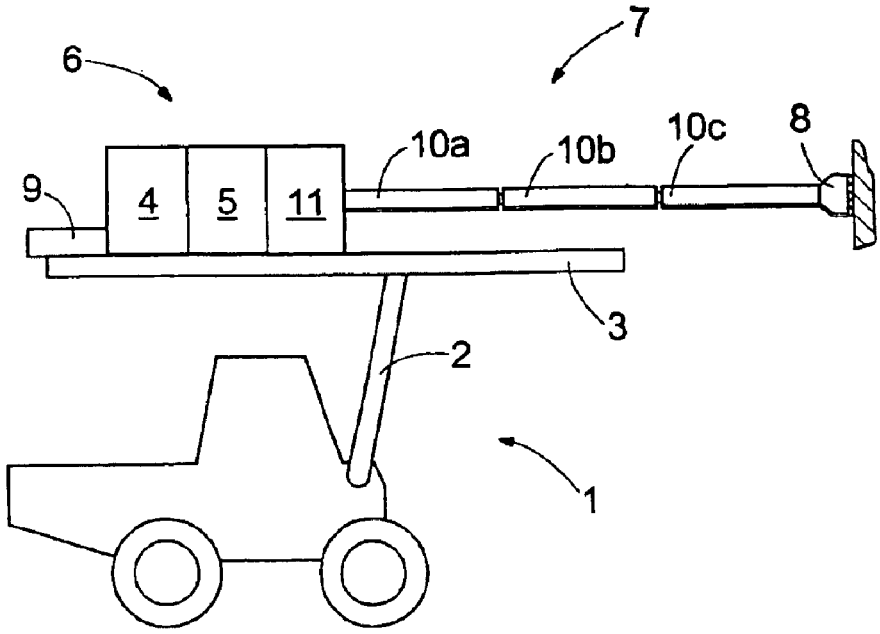
Figure 2:
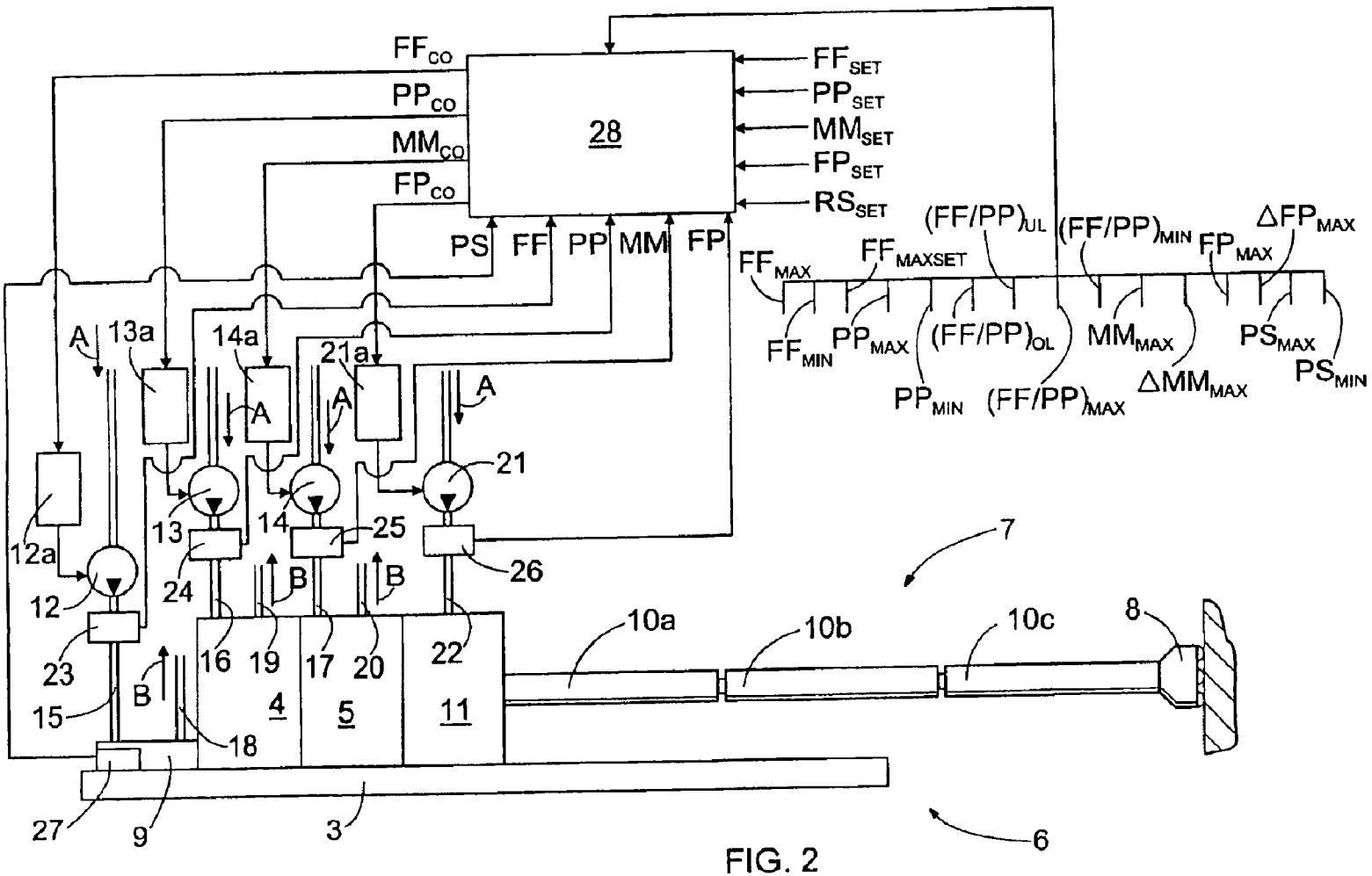
FIG. 2 is a schematic side view of the solution of the invention in connection with the rock drilling apparatus of FIG. 1.
Figure 4:
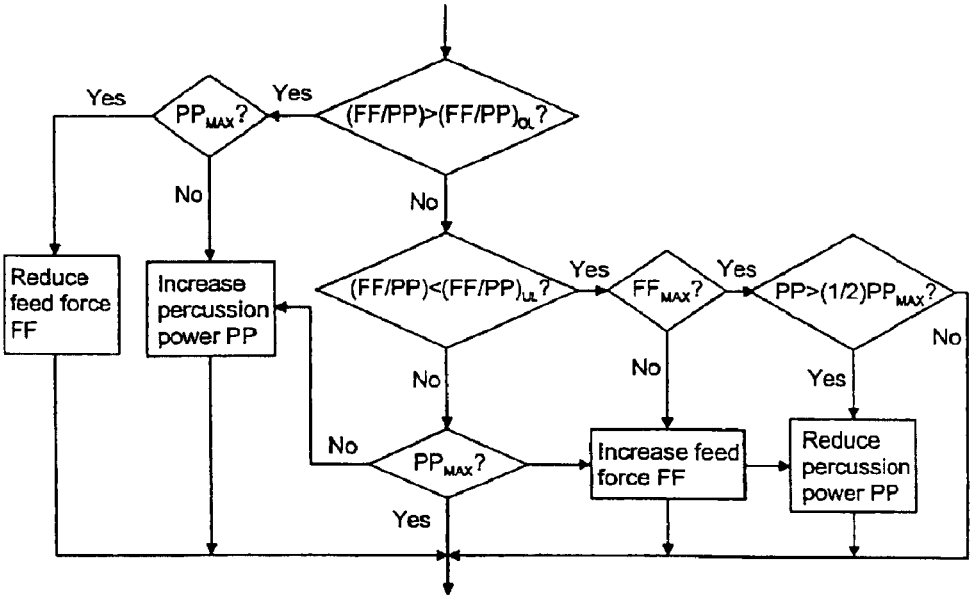
FIG. 4 is a block diagram of the principle of controlling the rock drilling apparatus for keeping the operation of the percussion device and the feeding device of the rock drilling apparatus within the targeted operating area.

FIG. 1 is a schematic and highly simplified side view of a rock drilling apparatus 1, to which the solution of the invention is applied and FIG. 2 is a schematic side view of the solution of the invention in connection with the rock drilling apparatus of FIG. 1. The rock drilling apparatus 1 comprises a boom 2, at the end of which there is a feed beam 3 with a rock drill machine 6 including a percussion device 4 and a rotating device 5. In general, the percussion device 4 comprises a percussion piston that moves by the effect of pressure medium and strikes the upper end of a tool 7 or a connecting piece arranged between the tool 7 and the percussion device 4, such as a drill shank. Naturally, the structure of the percussion device 4 can also be of some other type. The rear end of the tool 7 is connected to the rock drill machine 6 and at the outer end of the tool 7 there is a fixed or a detachable bit 8 for breaking rock. Typically, the bit 8 is a drill bit with buttons 8*a*, but other bit structures are also possible. The tool 7 and the bit 8 constitute the drill of the rock drill machine 1. The rotating device 5 transmits to the tool 7 continuous rotating force by the effect of which the bit 8 connected to the tool 7 changes its position after an impact of the percussion device and with a subsequent impact strikes a new spot in the rock. During drilling, the bit 8 is thrust with a feeding device 9 against the rock. The feeding device 9 is arranged in the feed beam 3, and the percussion device 4 and the rotating device 5 are arranged movably in connection therewith. The feeding device 9 can be a pressure-medium-operated cylinder, for instance, that is arranged to move the percussion device 4 and the rotating device 5 on the feed beam 3. The structure and operating principle of the feeding device 9 may vary, however. When deep holes are drilled, i.e. in so-called extension rod drilling, drill rods 10*a* to 10*c*, whose number depends on the depth of the hole to be drilled and which constitute the tool 7, are arranged between the bit 8 and the drilling machine 6. The drilling machine 6 comprises a flushing device 11 for supplying flushing agent through the tool 7 and the bit 8 of the drilling machine 6 so as to flush loose drilling waste from the drill hole. For the sake of clarity, FIG. 1 does not show the flushing holes of the bit 8. Further, FIG. 2 shows schematically a feed pump 12 intended for driving the feeding device 9, an impact pump 13 intended for driving the percussion device 4 and a rotation pump 14 intended for driving the rotating device 5, which supply pressurized pressure fluid, preferably hydraulic oil or bio-oil, each to the dedicated device they drive. Said pumps are arranged in a pressure channel 15, 16, 17 of each device, through which channels pressure fluid is supplied to said devices in the direction of arrow A. The pressure fluid returns from each device along return channels 18, 19, 20 of the devices in the direction of arrow B back to a container that is not shown in the figures for the sake of clarity. The drilling machine 6 also comprises a flushing pump 21, arranged in the pressure channel 22 of the flushing device 11, for supplying flushing agent, which is typically water, to the flushing device 11 in the direction of arrow A. The feed pump 12, impact pump 13, rotation pump 14 and flushing pump 21 are typically driven by motors 12*a*, 13*a*, 14*a* and 21*a*. For the sake of clarity, FIG. 2 does not show control valves used for the control of the percussion device 4, rotating device 5, feeding device 9 and flushing device 11. The structure and operation of the rock drilling apparatus and machine are known per se to the person skilled in the art, and therefore they are not discussed here in greater detail.

Figure 3:
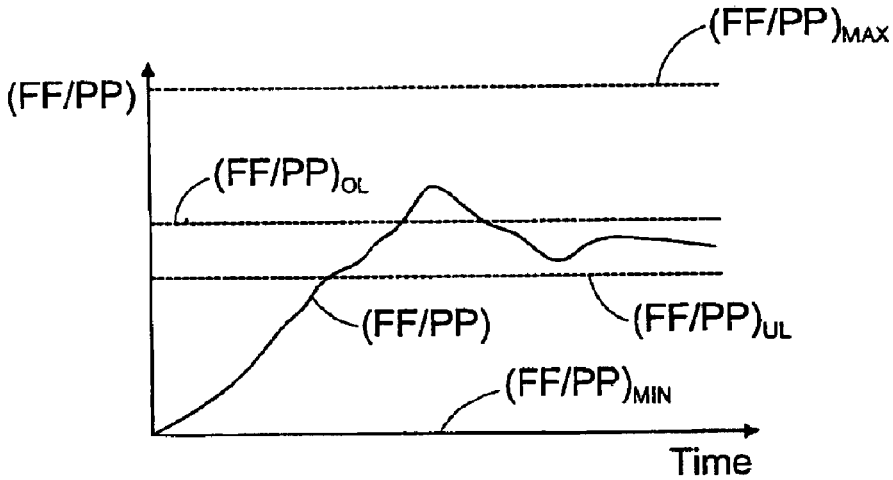
FIG. 3 shows schematically the principle of setting a targeted operating area of percussion device and feeding device control in the rock drilling apparatus.

It is very important for successful drilling that different drilling functions, which include rotating the drill in the drill hole, breaking the rock by striking a drill shank or directly the tool 7 with the percussion device and feeding the drill and flushing, are in correct relation to one another. It is particularly important that the mutual relation (FF/PP) of the feed force FF of the feeding device 9 and the percussion power PP of the percussion device 4 is correct. The control of the operation of the rock drilling apparatus 1 according to the invention is advantageously implemented such that for reducing the vibration risk in operating the rock drilling apparatus 1 or the rock drill machine 6 the relation (FF/PP) between the feed force FF of the feeding device 9 and the percussion power PP of the percussion device 4 is maintained within a desired, targeted operating area, instead of accurately aiming for a given, desired, target value. This principle is illustrated schematically in FIG. 3, where an upper limit $(FF/PP)_{OL}$ and a lower limit $(FF/PP)_{UL}$ are set for the relation (FF/PP) between the feed force FF of the feeding device 9 and the percussion power PP of the percussion device 4, and the relation (FF/PP) between the feed force FF of the feeding device 9 and the percussion power PP of the percussion device 4 is kept within the targeted operating area limited by said upper and lower limits for achieving successful drilling. In addition, FIG. 3 shows schematically the highest allowed feed force FF to percussion power PP relation $(FF/PP)_{MAX}$ and the lowest allowed feed force FF to percussion power PP relation $(FF/PP)_{MIN}$, which the drilling equipment tolerates without breaking. The feed force FF of the feeding device 9, or a variable depicting the same, is measured with a first pressure sensor 23 or a pressure transmitter 23 arranged in connection with the pressure channel 15 of the feeding device 9, and the percussion power PP of the percussion device 4, or a variable depicting the same, is measured with a second pressure sensor 24 or a pressure transmitter 24 arranged in connection with the pressure channel 16 of the percussion device 4. Naturally, it is clear that instead of the value or quotient (FF/PP) it is possible to use the value or quotient (PP/FF) as the mutual relation between the feed force FF of the feeding device 9 and the percussion power PP of the percussion device 4, whereby the necessary limit values are determined on the basis of said value or quotient (PP/FF).

In the control of the operation of the rock drilling apparatus, the aim is to keep the percussion power PP of the percussion device 4 as high as possible. Consequently, as the relation (FF/PP) of the feed force FF of the feeding device 9 to the percussion power PP of the percussion device 4 is within the targeted operating area limited by the upper limit $(FF/PP)_{OL}$ and the lower limit $(FF/PP)_{UL}$ shown in FIG. 3, the percussion power PP will be raised. If the feed force FF is found to be excessive with respect to the percussion power PP, the percussion power PP will be raised. However, if the percussion power PP already has the set maximum value $PP_{MAX}$, the feed force FF will be reduced. Correspondingly, if the feed force FF is found to be too low with respect to the percussion power PP, the feed force FF will be raised. If the feed force FF already has the set maximum value $FF_{MAX}$, the percussion power PP will be reduced. The adjustment of the relation (FF/PP) of the feed force FF to the percussion power PP such that the target area limited by the upper limit $(FF/PP)_{OL}$ and the lower limit $(FF/PP)_{UL}$ is not exceeded, is shown as a block diagram in FIG. 3.

Raising or reducing the percussion power PP and the feed force FF can be performed either directly by standard steps or by using P, PI, PID or any other corresponding algorithm. When necessary, each situation can employ either a different algorithm or the same algorithm with different parameters. The highest allowed value $PP_{MAX}$ or the lowest allowed value $PP_{MIN}$ of the percussion power PP is not changed during the drilling. The upper limit $FF_{MAX}$ of the feed force FF can be changed during the drilling, either by the control of the rotating torque MM of the rotating device 5 or the flushing pressure FP of the flushing device 11.

Figure 5:
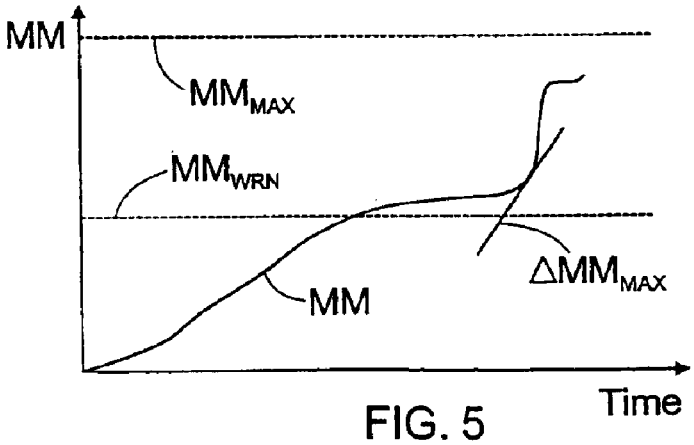
FIG. 5 shows schematically the principle of monitoring the operation of a rotating device and a flushing device of the rock drilling apparatus.
Figure 6:
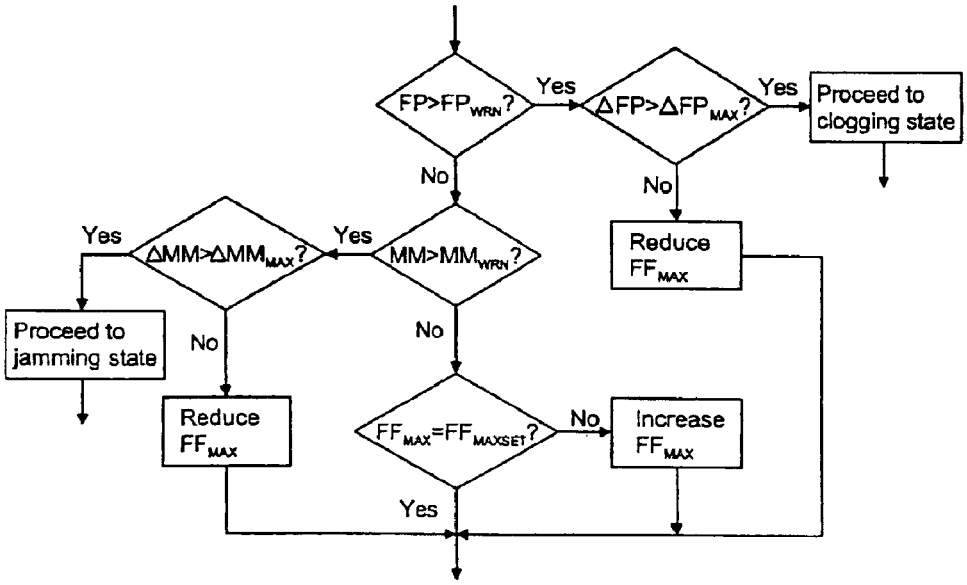
FIG. 6 is a block diagram of the operating principle of controlling rotating torque of a rotating device and flushing pressure of a flushing device.

The control of the mutual balance of the feed force FF of the feeding device 9 and the percussion power PP of the percussion device 4 can thus be implemented by the above-described solution. The upper limit $FF_{MAX}$ of the feed force FF can be changed during the drilling, either by the control of the rotating torque MM of the rotating device 5 or the flushing pressure FP of the flushing device 11. A rise in the rotating torque MM and in the flushing pressure FP may reveal either existing or forthcoming problems, such as jamming of the drilling equipment or clogging of the flushing holes in the drill bit. The control of drilling problem situations employs a method, in which the rotating torque MM and the flushing pressure FP are also provided with upper limits $\Delta MM_{MAX}$ and $\Delta FP_{MAX}$ for the changing rate of said variables ΔMM and ΔFP, in addition to the absolute upper limits of the measured variable $MM_{MAX}$ and $FP_{MAX}$, which is schematically shown in FIG. 5 for the rotating torque MM of the rotating device 5. In addition, a warning limit $MM_{WRN}$ and $FP_{WRN}$, which is lower than the absolute upper limit $MM_{MAX}$ and $FP_{MAX}$ of said variable, is set for the absolute value of said variable. When necessary, it is also possible to use a plurality of limit values for the absolute value and the changing rate value of said variable. The presented method can avoid malfunctions caused by slowly rising flushing pressure FP of the flushing device 11 and rotating torque MM of the rotating device 5 resulting from the increasing hole depth. Not until the drilling equipment is really jammed or clogged does a rise in the rotating torque MM or the flushing pressure FP bring about special measures. When the highest allowed value $MM_{MAX}$ or $FP_{MAX}$ of the rotating torque M or the flushing pressure FP is achieved, the highest allowed value $FF_{MAX}$ of the feed force FF will be reduced. And none of the warning limits being exceeded, the highest allowed value $FF_{MAX}$ of the feed force FF will be restored to the highest allowed set value $FF_{MAXSET}$ set for it for said drilling situation, which value cannot be changed to a higher level during said drilling situation. The principle of the rotating torque MM and the flushing pressure FP function control is shown as a block diagram in FIG. 6. The rotating torque MM of the rotating device 5, or a variable depicting it, can be measured with a third pressure sensor 25 or pressure transmitter 25 arranged in the pressure channel 17 of the rotating device 5 and the flushing pressure FP of the flushing device 11, or a variable depicting it, can be measured with a fourth pressure sensor 26 or pressure transmitter 26 arranged in the pressure channel 22 of the flushing device 11.

Figure 7:
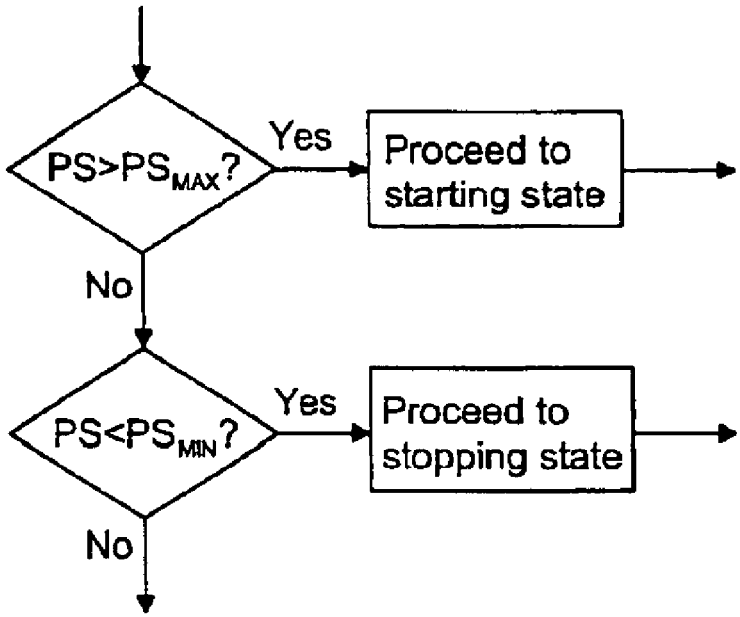
FIG. 7 is a block diagram of the operating principle of controlling drilling penetration rate.

In addition to the above-described controls, it is necessary to be able to limit the drilling penetration rate PS, for instance, when drilling into a void or when starting the drilling. For this purpose there is a separate penetration rate PS control, whose operating principle is shown as a block diagram in FIG. 7. As the penetration rate PS exceeds the highest allowed penetration rate $PS_{MAX}$, drilling is interrupted and a starting state of drilling is proceeded to, where the feed is under speed control and the percussion is at half power. As the penetration rate PS is below the lowest allowed penetration rate $PS_{MIN}$, drilling is stopped. By preventing the use of the rock drill machine 6 when the penetration rate PS is excessively low, it is possible to reduce equipment damage caused by the excessively low penetration rate PS. Prior to comparing the minima of the penetration rates PS it is possible to adjust the penetration rate PS value by proportioning it with the percussion power PP, whereby it is possible to avoid heating of equipment and joints thereof resulting from excessively high percussion power PP with respect to excessively low penetration rate PS, which makes the drilling equipment break down fairly quickly. The drilling penetration rate PS can be measured with a speed detector 27, for instance, which is arranged in connection with the feeding device 9 or the percussion device 4 and which is arranged to measure the drilling penetration rate PS directly. Alternatively, it is possible to measure a distance travelled by the percussion device 4 on the feed beam 3 in a given time, for instance, with sensor elements arranged in connection with the percussion device, which allows the determination of the drilling penetration rate on the basis of the time lapsed and the distance travelled.

Figure 8:
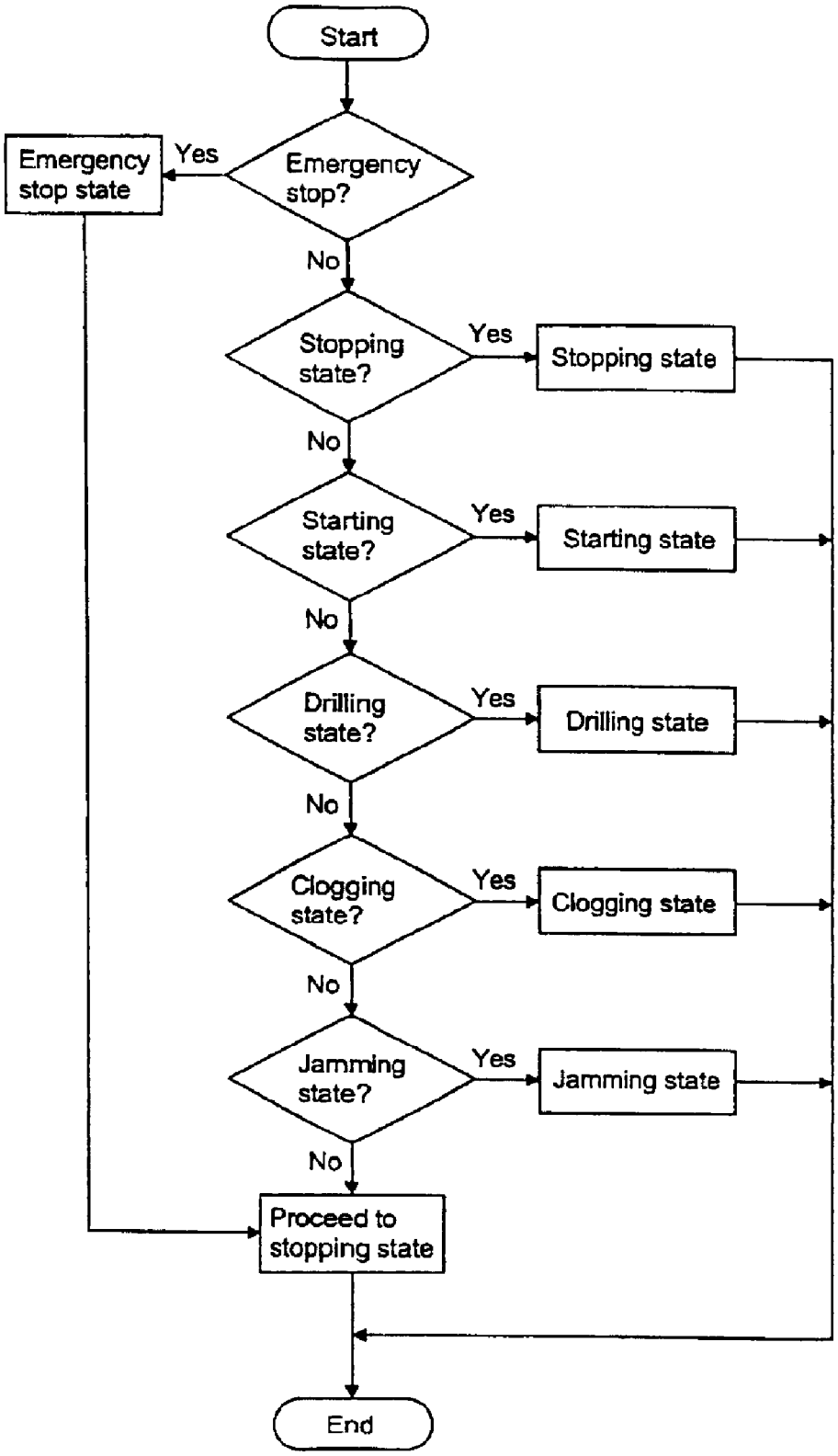
FIG. 8 is a block diagram of the operating principle of an upper level rock drilling apparatus control.

The actual controller is implemented as a 5-state controller, the states including stopping state of drilling, starting state, normal drilling state, jamming state of equipment and clogging state of flushing holes. In addition, the controller comprises an emergency stop state for stopping the drilling quickly in case of emergency. The upper level operating principle of the controller is shown as a block diagram in FIG. 8.

Figure 9:
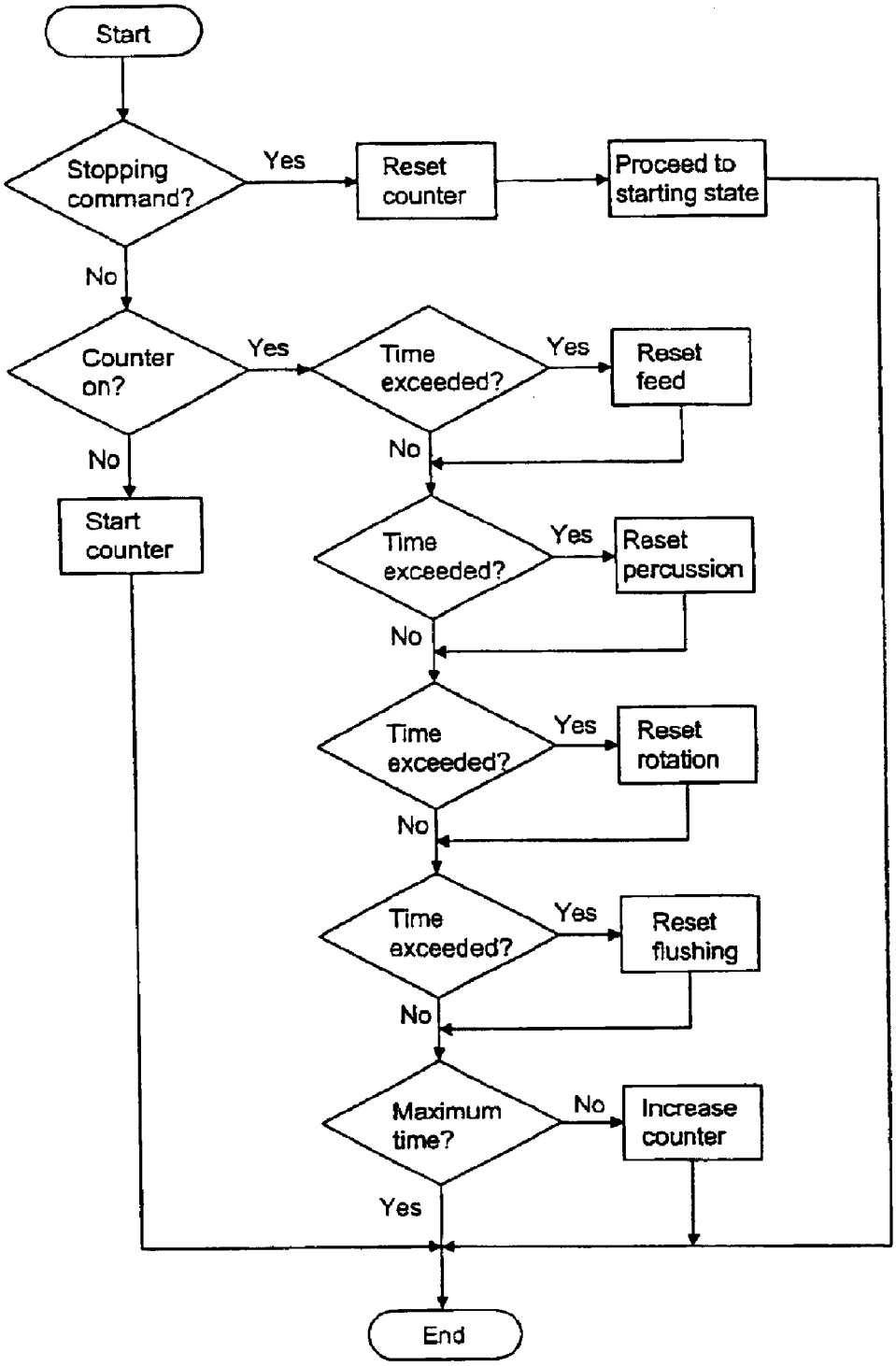
FIG. 9 is a block diagram of the operating principle of a stopping state of the rock drilling apparatus.

The operating principle of the stopping state is shown as a block diagram in FIG. 9. In the stopping state, the mutual stopping order and timing of different operations can be determined freely, i.e. each operation can be stopped at a desired time instant. Advantageously, the operations are stopped in the following order: feed, percussion, rotation, flushing. A counter controlling the stopping sequence employs an overflow buffer, whereby the counter counts up to its maximum value and remains in the maximum value until being reset in connection with a stopping state exit.

Figure 10:
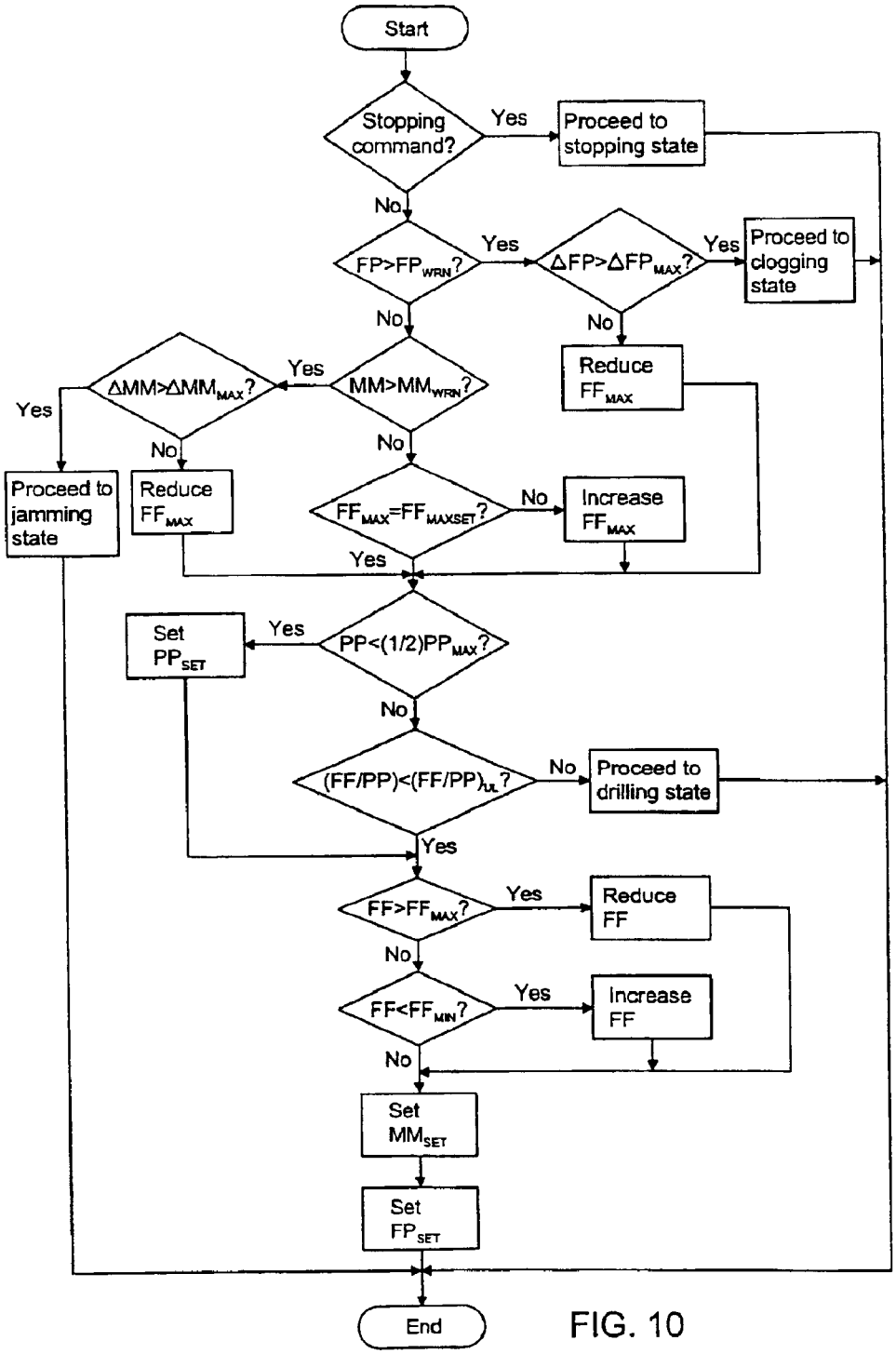
FIG. 10 is a block diagram of the operating principle of a starting state of the rock drilling apparatus.

The starting state is used when drilling is started from the beginning or in the middle of drilling a hole after a manually performed interruption, as well as when restarting the drilling after drilling into a void. The operating principle of the starting state of the drill machine is shown as a block diagram in FIG. 10. In the starting state, the controls of the rotating torque MM and the flushing pressure PF are on, but the drilling feed is under speed control. A transfer from the starting state to the drilling state takes place on the basis of a signal indicating the balance between the percussion power PP and the feed force FF.

The operating principle of a normal drilling state is shown schematically in FIGS. 11*a* and 11*b* by means of block diagrams such that the block diagram in FIG. 11*a* continues in FIG. 11*b*. The corresponding lines connecting the block diagrams of FIGS. 11*a* and 11*b* are indicated by CL1, CL2, CL3 and CL4 in FIGS. 11*a* and 11*b*. In the drilling state, the above-described closed-loop control is carried out, i.e. the operation of the drill machine control is adjusted automatically on the basis of the measurements and the control set values $FF_{SET}$, $PP_{SET}$, $MM_{SET}$ and $FP_{SET}$, such that the relation (FF/PP) of the feed force FF to the percussion power PP will be maintained as high as possible. The flushing pressure set value $FP_{SET}$ or the flushing flow set value $FS_{SET}$ can be set to have a fixed value or it can be changed as a function of the penetration rate PS and the percussion power PP, for instance. The need for flushing can thus be proportioned to the penetration rate PS, which is in direct proportion to the volume of removable rock material in a time unit. The percussion power PP will have a connecting factor to the hardness of rock material, i.e. if the penetration rate PS is high at a relatively low percussion power, flushing should be generally slightly increased, because rock is then soft, and the produced drill hole may have a larger diameter than the nominal diameter and thus the amount of removable rock material per time unit may also be larger. Mathematically expressed $$\text{flushing flow}=a_1\times\text{penetration rate}+b_1\times\text{percussion power.}$$

Likewise, the set value $RS_{SET}$ of the rotating rate RS can be maintained constant or changed as a function of percussion frequency, for instance. For each drill bit there is a specific, optimal slewing angle between two successive percussions. This slewing angle varies to some extent according to the rock hardness. Mathematically expressed $$\text{rotating rate}=a_2\times\text{impact frequency}+b_2\times\text{percussion power.}$$

When a jamming risk of equipment is detected, either the absolute value of the rotating torque MM or the changing rate value ΔMM of the rotating torque exceeding the set limit value, a jamming state of drilling is adopted, the operating principle of which is shown as a block diagram in FIG. 12. In the jamming state the aim is to detach the equipment by running the feed backwards either for a given preset distance or up to the return limit. At the same time the set value $RS_{SET}$ of the rotating rate RS and the percussion power PP are set to the maximum values. The equipment being detached, the drilling is restarted. If the equipment cannot be detached within the time limit set for a counter monitoring the jamming of the equipment, the drilling will be stopped.

The operating principle of the clogging state of flushing holes is shown as a block diagram in FIG. 13. When there is a risk that the flushing holes will clog, the same procedure is adopted as in the case of the jamming state, but instead of changing the set value $RS_{SET}$ of the rotating rate RS, the set value of the flushing pressure FP or the flushing flow FS will be changed.

For implementing the solution of the invention the rock drill machine 1 comprises a control unit 28, which may be a microprocessor, a signal processor, a programmable logic circuit or a similar data processing unit, which can implement the required functions described above. The control unit 28 determines control variables $FF_{CO}$, $PP_{CO}$, $MM_{CO}$ and $FP_{CO}$ on the basis of the measured data, or data determined therefrom by further processing, for controlling a motor 12*a* driving a feed pump 12, a motor 13*a* driving a percussion pump 13, a motor 14*a* driving a rotation pump 14 and a motor 21*a* driving a flushing pump 21. The control unit 28 is also used for setting the set values and the limit values, i.e. the highest and the lowest allowed values for the variables to be controlled and monitored. There may be a plurality of control units 28, and in that case the operations for controlling the rock drilling apparatus 1 can be distributed to different control units, which can communicate via data transmission buses provided between them.

The solution of the invention is applicable as such for drilling short and long holes alike. The solution can be implemented in a simple manner, because the necessary sensor elements and other equipment can be implemented in a simple manner. Thanks to closed-loop control, i.e. controlling the drilling automatically on the basis of measurements, it is easy to use the rock drilling machine also in demanding drilling conditions and the operator can learn easily and quickly how to use different rock drilling machines. The solution reduces in a simple manner the stress, which the impacts of the percussion device produce and to which the drilling equipment is subjected, and prevents the equipment from getting damaged or jammed, or the flushing holes of the bit from clogging during the normal operation of the rock drilling apparatus or due to the misuse of the rock drilling apparatus.

The drawings and the relating specification are only intended to illustrate the inventive idea. The details of the invention may vary within the scope of the claims. The pressure medium used is preferably pressure fluid, such as hydraulic oil or water, for instance. However, the pressure medium used can also be compressed air, whereby the structure of the rock drilling apparatus corresponds to that of a typical pneumatic rock drilling apparatus, but the operating principle and the controlling principle remain in accordance with the solution described.

What is claimed is:

1. A method for controlling the operation of a rock drilling apparatus, which rock drilling apparatus comprises a percussion device, a rotating device, a feeding device, a flushing device, a tool and a bit arranged in the tool, and in which rock drilling apparatus the percussion device is arranged to produce impact energy directed to the tool, the rotating device is arranged to rotate the tool in a drill hole, the feeding device is arranged to feed the tool in the drill hole and the flushing device is arranged to supply flushing agent through the tool and the bit for flushing detached drilling waste from the hole, the method comprising setting the highest allowed feed force of the feeding device and the lowest allowed feed force of the feeding device, setting the highest allowed percussion power of the percussion device and the lowest allowed percussion power of the percussion device, setting upper and lower limits for the relation between the feed force of the feeding device and the percussion power of the percussion device, which upper and lower limits serve as limits for a targeted operating area of the relation between the feed force of the feeding device and the percussion power of the percussion device, determining the feed force of the feeding device and the percussion power of the percussion device, determining the relation between the feed force of the feeding device and the percussion power of the percussion device on the basis of the feed force of the feeding device and the percussion power of the percussion device and adjusting the feed force of the feeding device and the percussion power of the percussion device such that the relation between the feed force of the feeding device and the percussion power of the percussion device is within the targeted operating area limited by said upper and lower limits.

2. A method as claimed in claim 1, wherein the feed force of the feeding device is determined on the basis of the pressure in a pressure channel of the feeding device and the percussion power of the percussion device is determined on the basis of the pressure in a pressure channel of the percussion device.

3. A method as claimed in claim 1, wherein when the relation between the feed force of the feeding device and the percussion power of the percussion device is within the targeted operating area, the percussion power of the percussion device will be increased.

4. A method as claimed in claim 3, wherein when the feed force of the feeding device is excessive as compared with the percussion power of the percussion device, the percussion power of the percussion device will be increased.

5. A method as claimed in claim 4, wherein when the percussion power of the percussion device is in the set maximum value, the feed force of the feeding device will be reduced.

6. A method as claimed in claim 1, wherein when the feed force of the feeding device is excessively low as compared with the percussion power of the percussion device, the feed force of the feeding device will be increased.

7. A method as claimed in claim 6, wherein when the feed force of the feeding device is in the set maximum value, the percussion power of the percussion device will be reduced.

8. A method as claimed in claim 1, wherein the feed force of the feeding device or the percussion power of the percussion device is changed by standard steps or by using P, PI or PID algorithm.

9. A method as claimed in claim 1, comprising further determining a rotating torque of the rotating device, determining a change in the rotating torque of the rotating device, setting the highest allowed value for the rotating torque of the rotating device, setting the highest allowed value for the change in the rotating torque of the rotating device and setting the highest allowed value for the feed force of the feeding device on the basis of the rotating torque of the rotating device or the change in the rotating torque of the rotating device.

10. A method as claimed in claim 9, wherein the rotating torque or the change in the rotating torque of the rotating device is determined on the basis of the pressure in the pressure channel of the rotating device.

11. A method as claimed in claim 9, comprising further comparing the rotating torque of the rotating device with the highest allowed value of the rotating torque, comparing the value of a change in the rotating torque of the rotating device with the highest allowed value of the change in the rotating torque, and reducing the highest allowed value of the feed force of the feeding device when the rotating torque of the rotating device exceeds the highest allowed rotating torque value or when the change in the rotating torque of the rotating device exceeds the highest allowed value of the change in the rotating torque.

12. A method as claimed in claim 9, comprising further comparing the rotating torque of the rotating device with the highest allowed value of the rotating torque, comparing the value of the change in the rotating torque of the rotating device with the highest allowed value of the change in the rotating torque and setting the highest allowed value of the feed force of the feeding device to its set value when the rotating torque of the rotating device at most equals the highest allowed value of the rotating torque and when the change in the rotating torque of the rotating device at most equals the highest allowed value of the change in the rotating torque.

13. A method as claimed in claim 1, comprising further determining flushing pressure of the flushing device, determining a change in the flushing pressure of the flushing device, setting the highest allowed value for the flushing pressure of the flushing device, setting the highest allowed value for the change in the flushing pressure of the flushing device and setting the highest allowed value for the feed force of the feeding device on the basis of the flushing pressure of the flushing device or the change in the flushing pressure of the flushing device.

14. A method as claimed in claim 13, wherein the flushing pressure of the flushing device or the change in the flushing pressure of the flushing device is determined on the basis of the pressure in the pressure channel of the flushing device.

15. A method as claimed in claim 13, comprising further comparing the flushing pressure of the flushing device with the highest allowed value of the flushing pressure, comparing the change in the flushing pressure of the flushing device with the highest allowed value of the change in the flushing pressure and reducing the highest allowed feed force value of the feeding device when the flushing pressure of the flushing device exceeds the highest allowed flushing pressure value or when the change in the flushing pressure of the flushing device exceeds the highest allowed value of the change in the flushing pressure.

16. A method as claimed in claim 13, comprising further comparing the flushing pressure of the flushing device with the highest allowed value of the flushing pressure, comparing the change in the flushing pressure of the flushing device with the highest allowed value for the change in the flushing pressure, and setting the highest allowed value of the feed force of the feeding device to its set value when the flushing pressure of the flushing device at most equals the highest allowed value of the flushing pressure or when the change in the flushing pressure of the flushing device at most equals the highest allowed value of the change in the flushing pressure.

17. A method as claimed in claim 1, comprising further determining a drilling penetration rate, setting the highest allowed drilling penetration rate, setting the lowest allowed drilling penetration rate comparing the drilling penetration rate with the highest allowed drilling penetration rate and when the drilling penetration rate exceeds the highest allowed penetration rate, interrupting the drilling and restarting it again and/or comparing the drilling penetration rate with the lowest allowed drilling penetration rate, and when the drilling penetration rate is below the lowest allowed penetration rate, interrupting the drilling.

18. A method as claimed in claim 17, wherein the drilling penetration rate is determined by measuring the drilling penetration rate directly.

19. Equipment for controlling the operation of a rock drilling apparatus, which rock drilling apparatus comprises a percussion device, a rotating device, a feeding device, a flushing device, a tool and a bit arranged in the tool, and in which rock drilling apparatus the percussion device is arranged to produce impact energy directed to the tool, the rotating device is arranged to rotate the tool in a drill hole, the feeding device is arranged to feed the tool in the drill hole and the flushing device is arranged to supply flushing agent through the tool and the bit for flushing the detached drilling waste from the hole, the equipment comprising means for setting the highest allowed feed force of the feeding device and the lowest allowed feed force of the feeding device, means for setting the highest allowed percussion power of the percussion device and the lowest allowed percussion power of the percussion device, means for setting upper and lower limits for the relation between the feed force of the feeding device and the percussion power of the percussion device, which upper and lower limits serve as limits for a targeted operating area of the mutual relation between the feed force of the feeding device and the percussion power of the percussion device, means for determining the feed force of the feeding device and the percussion power of the percussion device, means for determining the relation between the feed force of the feeding device and the percussion power of the percussion device on the basis of the feed force of the feeding device and the percussion power of the percussion device, and at least one control unit for adjusting the feed force of the feeding device and the percussion power of the percussion device such that the relation between the feed force of the feeding device and the percussion power of the percussion device is within the targeted operating area limited by said upper and lower limits.

20. Equipment as claimed in claim 19, wherein at least the following states for controlling the operation of the rock drilling apparatus are determined in the control unit: emergency stop state, stop drilling state, start drilling state, normal drilling state, drilling jammed state and flushing holes clogged in the bit of the rock drill tool state.

21. Equipment as claimed in claim 19, wherein the equipment comprises at least one first pressure sensor for determining the feed force of the feeding device on the basis of the pressure in the pressure channel of the feeding device and at least one second pressure sensor for determining the percussion power of the percussion device on the basis of the pressure in the pressure channel of the percussion device.

22. Equipment as claimed in claim 19, wherein the equipment further comprises means for determining a rotating torque of the rotating device and a change in the rotating torque of the rotating device, means for setting the highest allowed value for the rotating torque of the rotating device and the highest allowed value for the change in the rotating torque of the rotating device, and means for setting the highest allowed value for the feed force of the feeding device on the basis of the rotating torque of the rotating device or the change in the rotating torque of the rotating device.

23. Equipment as claimed in claim 22, wherein the equipment comprises at least a third pressure sensor for determining the rotating torque and/or the change in the rotating torque of the rotating device on the basis of the pressure in the pressure channel of the rotating device.

24. Equipment as claimed in claim 22, wherein the equipment comprises means for comparing the rotating torque of the rotating device with the highest allowed value of the rotating torque or for comparing the value of a change in the rotating torque of the rotating device with the highest allowed value of the change in the rotating torque.

25. Equipment as claimed in claim 24, wherein the equipment further comprises means for reducing the highest allowed value of the feed force of the feeding device when the rotating torque of the rotating device exceeds the highest allowed rotating torque value or when the change in the rotating torque of the rotating device exceeds the highest allowed value of the change in the rotating torque.

26. Equipment as claimed in claim 24, wherein the equipment further comprises means for setting the highest allowed value of the feed force of the feeding device to its set value when the rotating torque of the rotating device at most equals the highest allowed value of the rotating torque and when the change in the rotating torque of the rotating device at most equals the highest allowed value of the change in the rotating torque.

27. Equipment as claimed in claim 19, wherein the equipment further comprises means for determining flushing pressure of the flushing device and a change in the flushing pressure of the flushing device, means for setting the highest allowed value for the flushing pressure of the flushing device and the highest allowed value for the change in the flushing pressure of the flushing device, and means for setting the highest allowed value for the feed force of the feeding device on the basis of the flushing pressure of the flushing device or the change in the flushing pressure of the flushing device.

28. Equipment as claimed in claim 27, wherein the equipment comprises at least one fourth pressure sensor for determining flushing pressure of the flushing device and/or a change in the flushing pressure of the flushing device on the basis of the pressure in the pressure channel of the flushing device.

29. Equipment as claimed in claim 27, wherein the equipment further comprises means for comparing the flushing pressure of the flushing device with the highest allowed value of the flushing pressure or the change in the flushing pressure of the flushing device with the highest allowed value for the change in the flushing pressure.

30. Equipment as claimed in claim 29, wherein the equipment further comprises means for reducing the highest allowed feed force value of the feeding device when the flushing pressure of the flushing device exceeds the highest allowed flushing pressure value or when the change in the flushing pressure of the flushing device exceeds the highest allowed value for the change in the flushing pressure.

31. Equipment as claimed in claim 29, wherein the equipment further comprises means for setting the highest allowed value of the feed force of the feeding device to its set value when the flushing pressure of the flushing device at most equals the highest allowed value for the flushing pressure or when the change in the flushing pressure of the flushing device at most equals the highest allowed value for the change in the flushing pressure.

32. Equipment as claimed in claim 19, wherein the equipment further comprises means for determining a drilling penetration rate, means for determining the highest allowed drilling penetration rate and the lowest allowed drilling penetration rate, means for comparing the drilling penetration rate with the highest allowed drilling penetration rate and the lowest allowed drilling penetration rate, means for interrupting the drilling and restarting it when the drilling penetration rate exceeds the highest allowed penetration rate, and means for interrupting the drilling when the drilling penetration rate is below the lowest allowed penetration rate.

33. Equipment as claimed in claim 32, wherein the equipment comprises at least one speed detector for determining the drilling penetration rate by measuring directly the drilling penetration rate.

* * * * *

UNITED STATES PATENT AND TRADEMARK OFFICE

CERTIFICATE OF CORRECTION

PATENT NO. : 6,938,702 B2
APPLICATION NO. : 10/497860
DATED : September 6, 2005
INVENTOR(S) : Saha et al.

It is certified that error appears in the above-identified patent and that said Letters Patent is hereby corrected as shown below:

On the Title page, at Item (73) Assignee, please replace "Sandvik Inteleectual Property AB, Sandviken (SE)" with --Sandvik Tamrock OY, Tampere (FI)--.

Signed and Sealed this

Fourth Day of December, 2007

JON W. DUDAS
*Director of the United States Patent and Trademark Office*